US005761926A

United States Patent [19]

Luis

[11] Patent Number: 5,761,926

[45] Date of Patent: Jun. 9, 1998

[54] PRE-COOLER DEVICE

[75] Inventor: Daniel Luis, Hialeah, Fla.

[73] Assignee: Lujada, Inc., Hialeah, Fla.

[21] Appl. No.: 666,156

[22] Filed: Jun. 19, 1996

[51] Int. Cl.[6] ..... F25B 41/00; F25B 5/00

[52] U.S. Cl. ..... 62/513; 62/199; 62/498

[58] Field of Search ..... 62/513, 199, 197, 62/498

[56] References Cited

U.S. PATENT DOCUMENTS 4,696,168 9/1987 Woods et al. ..... 62/513 X 4,811,568 3/1989 Horan et al. ..... 62/513 X

*Primary Examiner*—William E. Wayner

*Attorney, Agent, or Firm*—J. Sanchelima

[57] ABSTRACT

An improvement for a refrigeration system that includes a refrigerant circuit and a compressor with condenser assembly. The improvement is a pre-cooling device connected to the output of the condenser and includes an inlet and two outlets. The inlet is connected to a serpentine at one end and the other end is connected to one of the outlets. The other outlet is connected to the device housing above the bottom concavity where the liquid refrigerant is collected. The serpentine comes in at least partial contact with the refrigerant and in that manner pre-cooling the refrigerant going through the serpentine.

3 Claims, 1 Drawing Sheet

PRE-COOLER DEVICE

BACKGROUND OF THE INVENTION

1. Field of the Invention

The present invention relates to a pre cooler device, and more particularly, to the type that is installed in a refrigeration system used in vehicles.

2. Description of the Related Art

Applicant believes that the closest reference corresponds to U.S. Pat. No. 4,696,168 issued to Woods et al. However, it differs from the present invention because Woods requires the use of two housings, there is no contact with the refrigerant in liquid form and it does not provide for a safety valve within the housing.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a pre cooler device that can be readily installed in conventional refrigeration or air conditioning systems used in vehicles with a minimal of modifications to achieve a lower temperature of the refrigerant before it enters the evaporator assembly.

It is still another object of this invention to provide a device that prevents the escape of the lubricant in a refrigerant circuit thus avoiding expensive damage to the compressor unit.

It is another object of this invention to provide a pre-cooler device that can be easily installed in existing motor vehicles to prevent dangerous pressure buildup.

It is another object of this invention to provide a device that operates more efficiently at lower temperatures thus reducing the wear and tear of the refrigeration components.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
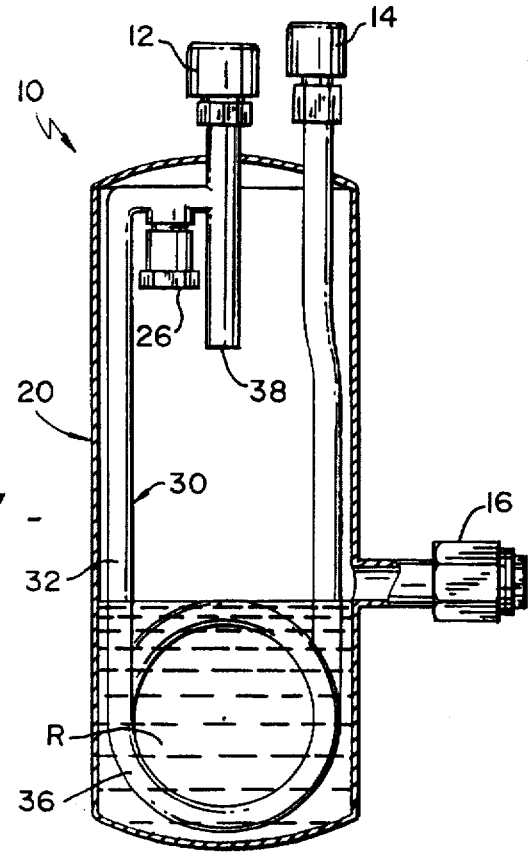
FIG. 1 is an elevational partial cross sectional view of the pre-cooler, subject of the present invention.
Figure 2:
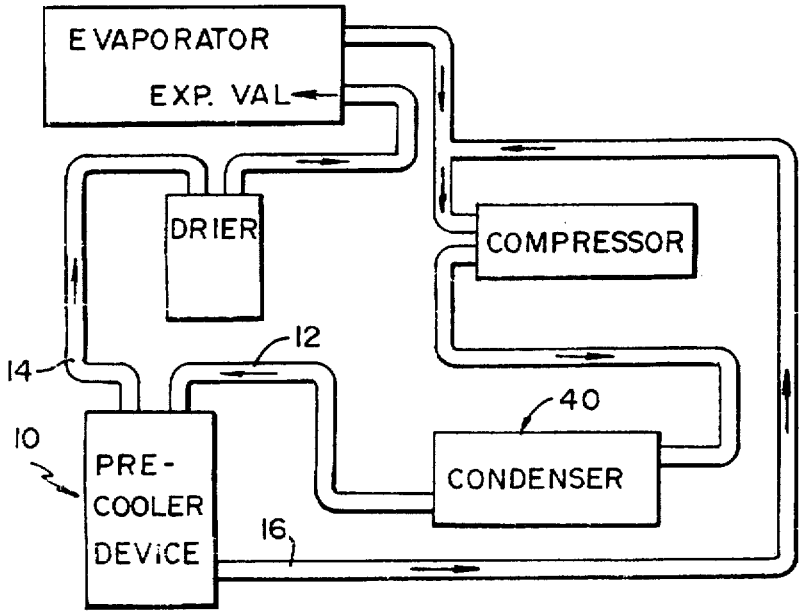
FIG. 2 shows schematic diagram of an air conditioning system in a motor vehicle showing the present invention incorporated therein.

Referring now to the drawings, where the present invention is generally referred to with numeral 10, it can be observed that it basically includes container assembly 20 which is an elongated tubular body with inlet and outlet. The refrigerant from condenser 40 enters at high pressure through inlet 12 and most of it proceeds to go through serpentine assembly 30 and out through outlet 14. Some of the pressurized refrigerant, however, is diverted to secondary expansion valve 38 which allows the diverted refrigerant to expand lowering the temperature inside container assembly 20. Since tube portion 36 of serpentine assembly 30 is immersed in the collected and colder refrigerant R, the bulk of the high pressure refrigerant is cooled down resulting is a lower temperature refrigerant exiting through outlet 14.

The diverted refrigerant that expands inside assembly 20 as it comes out through secondary expansion valve 38 and does not condense at the bottom of assembly 20 proceeds out through outlet 16. The refrigerant coming out of outlet 16 is at a considerably lower temperature than the refrigerant at outlet 12. This increases the cooling capacity of the serpentine.

Another feature of the present invention is that in the event there is a pressure buildup in the system, pressure safety valve assembly 26 is activated releasing the high pressure refrigerant inside assembly 20. In this manner, the refrigerant is not released to the atmosphere with the consequent ecological aftermath and the lubricant is not allowed to escape thus preventing irreversible damage to the compressor unit.

It has been found that with the present invention the interior of a vehicle is cooled down faster than without the invention, and that a lower temperature is achieved, after several minutes. This is primarily due to the immersion of cooling serpentine portion 36 in the colder liquid refrigerant R.

It is the objective of this invention to improve the efficiency of the refrigeration system and extend the life of its components of the refrigeration system have been designed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. In a refrigeration system that includes a compressor with condenser assembly and an evaporator assembly interconnected in a closed circuit with pipelines and a refrigerant circulating from said condenser assembly to said evaporator assembly, and from said evaporator assembly back to said condenser assembly, and said refrigerant being periodically compressed and expanded, the improvement comprising a pre-cooler device connected in series with said pipeline conducting said refrigerant from said compressor with condenser assembly to said evaporator assembly, said pre-cooler device having a housing with an inlet, first and second outlets, said inlet being connected to said pipeline coming from said condenser assembly and said pre-cooler device further including serpentine pipeline means connecting said inlet and first outlet port and said inlet port including a secondary expansion valve means for releasing a portion of said incoming refrigerant inside said housing thereby lowering the temperature therein so that the temperature of the refrigerant going therethrough is also lowered, and said second outlet being connected to said pipeline carrying said refrigerant to said compressor with condenser assembly, and wherein said housing is vertically disposed and includes a bottom defining a concavity wherein said serpentine pipeline means is positioned so that when some of said refrigerant is collected in liquid form within said concavity said liquid comes in contact with at least a portion of said serpentine pipeline means.

2. The improvement set forth in claim 1 wherein said second outlet means is positioned above said serpentine pipe line means.

3. The improvement set forth in claim 2 wherein said inlet means includes pressure safety valve means housed within said housing.

* * * * *